US006647916B2

(12) United States Patent
Neese et al.

(10) Patent No.: US 6,647,916 B2
(45) Date of Patent: Nov. 18, 2003

(54) FOLD OUT BOAT SEAT

(75) Inventors: David A. Neese, Winterville, NC (US); Drexel K. Smith, Greenville, NC (US)

(73) Assignee: Grady-White Boats, Inc., Greenville, NC (US)

( * ) Notice: Subject to any disclaimer, the term of this patent is extended or adjusted under 35 U.S.C. 154(b) by 0 days.

(21) Appl. No.: 10/125,706

(22) Filed: Apr. 18, 2002

(65) Prior Publication Data

US 2003/0196582 A1 Oct. 23, 2003

(51) Int. Cl.[7] ..... B63B 17/00
(52) U.S. Cl. ..... 114/363; 297/14
(58) Field of Search ..... 114/363; 297/14; 108/134

(56) References Cited

U.S. PATENT DOCUMENTS

| | | | | | |
|---|---|---|---|---|---|
| 945,208 | A | * | 1/1910 | Arter | 297/14 |
| 1,017,364 | A | | 2/1912 | Albert | |
| 1,355,005 | A | * | 10/1920 | Schechter | 297/14 |
| 1,361,700 | A | | 12/1920 | Elzey | |
| 1,428,018 | A | | 9/1922 | Erickson | |
| 1,502,152 | A | * | 7/1924 | Millett | 108/38 |
| 1,509,863 | A | | 9/1924 | Erickson | |
| 1,761,673 | A | * | 6/1930 | Laursen | 297/14 |
| 1,784,390 | A | * | 12/1930 | Rice | 297/14 |
| 2,472,185 | A | * | 6/1949 | Apel | 114/363 |
| 2,583,372 | A | | 1/1952 | Hall | |
| 3,376,587 | A | | 4/1968 | Staron | |
| 3,428,976 | A | * | 2/1969 | Robinson | 114/363 |
| 3,475,773 | A | * | 11/1969 | Codman, Jr. | 114/363 |
| 4,009,903 | A | * | 3/1977 | Manspeaker | 297/14 |
| 4,791,873 | A | * | 12/1988 | Towfigh | 108/134 |
| 4,934,303 | A | * | 6/1990 | Lathers et al. | 114/363 |
| 5,791,729 | A | * | 8/1998 | McCormick et al. | 297/14 |
| 6,283,059 | B1 | * | 9/2001 | Scully, Jr. | 114/363 |

* cited by examiner

*Primary Examiner*—S. Joseph Morano
*Assistant Examiner*—Andrew Wright
(74) *Attorney, Agent, or Firm*—Olive & Olive, P.A.

(57) ABSTRACT

A fold out bench type boat seat assembly is attached to the bulkhead of a boat. The seat assembly comprises two sections: a backrest that is fixedly attached to the bulkhead, and a seat unit that is movable from a vertical stored position against the boat bulkhead to a horizontal seating position the major portions of which are detachable from the bulkhead when not needed.

8 Claims, 6 Drawing Sheets

FOLD OUT BOAT SEAT

FIELD OF THE INVENTION

The present invention is directed to a stowable fold out seat assembly for boats. More particularly, the present invention relates to a bench seat boat assembly that can be folded and stored against a bulkhead of a boat when not in use and whose seat unit can be detached and removed from the bulkhead when not needed.

BACKGROUND OF THE INVENTION

As the boat industry has been more family oriented, multi-purpose seating apparatus has become increasingly important. It is well known in the boat industry to provide, for example, combination seating/storage or seating/bed apparatus and which make efficient use of the limited space available aboard boats. In seating/storage apparatus, a separable lid is placed over a container. The lid serves both as a top for the container and as a seat for a passenger. The lid is often upholstered to improve the aesthetic appearance of the apparatus and increase comfort for the passenger. The lid may also be hinged to allow the lid to pivot about an edge and ultimately rest against a backrest of the seating/storage apparatus.

Fishing boats often have a limited amount of open space in which the fisherman is free to move from port to starboard and stem to bow while fishing. As described above, each seat provided around the deck of the boat may include a storage area provided beneath a seat surface. Moreover, each seat may be a stationary and closed structure formed integrally with the deck and the bulkhead. While conventional seat structures serve useful purposes, they often times interfere with a fisherman's ability to move about quickly from one position to another while fishing. It is particularly undesirable to have a permanent seat fixed in its sitting position with the horizontal part of the seat coming out from the bulkhead because it takes up too much room. Therefore, in order to provide a seat in a limited amount of space, while making it big enough to sit on, the seat ordinarily does not have a backrest. If the seat is made low enough to sit on, the seat width gets too short. Thus, the present invention recognizes that the ideal seat needs to be able to be stowed against the boat bulkhead and be big enough in both its back and seat portion to be comfortable for the user.

While it has been known to provide seats on a boat which can be folded out to provide a bench-like seat, such fold-out bench-type seats of conventional construction like the many advantages of the present invention as set forth below.

Accordingly, there is a need in the art of fishing boat manufacture for a seating apparatus which when not being used is adapted to be stowed in a manner to provide a maximum amount of deck space for fishing activities.

There is a further need for an improved seating apparatus which when placed in either its stowed or seating position tends to maintain and not inadvertently move out of such position.

With the above in mind, it is an object of the present invention to provide a fold out bench type boat seat that is economical to manufacture, simple to operate, and is aesthetically pleasing to the boat user.

A further object of the present invention is to provide a fold out bench type boat seat that, when not needed for seating, may be folded into a stowed position and made to reside fixed against the bulkhead of the boat out of the fisherman's way.

A still further object of the present invention is to provide a fold out bench type boat seat that both preserves storage space within the bulkhead and yet makes accessible any space behind the seat locations where there might be, for example, a storage compartment, thus solving a significant problem and a need of the boat industry.

Also, an object of the present invention is to provide a fold out bench type boat seat assembly whose seat unit is removable so one can easily detach the seat unit from the boat and leave it at the dock if so desired.

Other objects and advantages of the invention will be more fully apparent from the following disclosure and appended claims.

SUMMARY OF THE INVENTION

The present invention provides a fold out bench type boat seat assembly that is attached to the bulkhead of a boat. The seat comprises two sections: a back support that is fixedly attached to the bulkhead, and a seat unit detachably mounted in a pair of laterally spaced vertical slide blocks fixedly attached to the bulkhead and movable from a vertical stowed position against the boat bulkhead to a horizontal seating position.

The present invention and its features and advantages will be more fully understood, and further features and advantages will become apparent, when reference is made to the following detailed description of the invention, including the drawings, and the claims.

DESCRIPTION OF THE PREFERRED EMBODIMENT

Figure 4C:
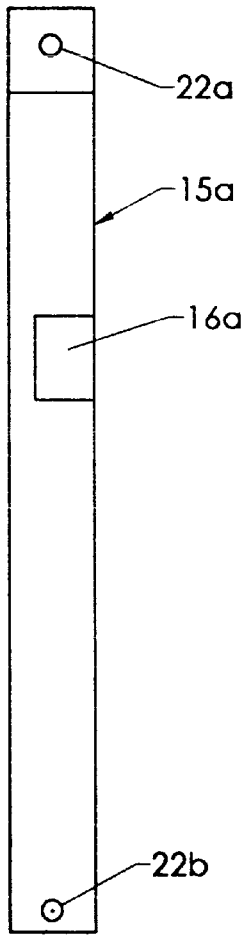
FIG. 4C is a front elevation view of the slide block of FIG. 4A.
Figure 4B:
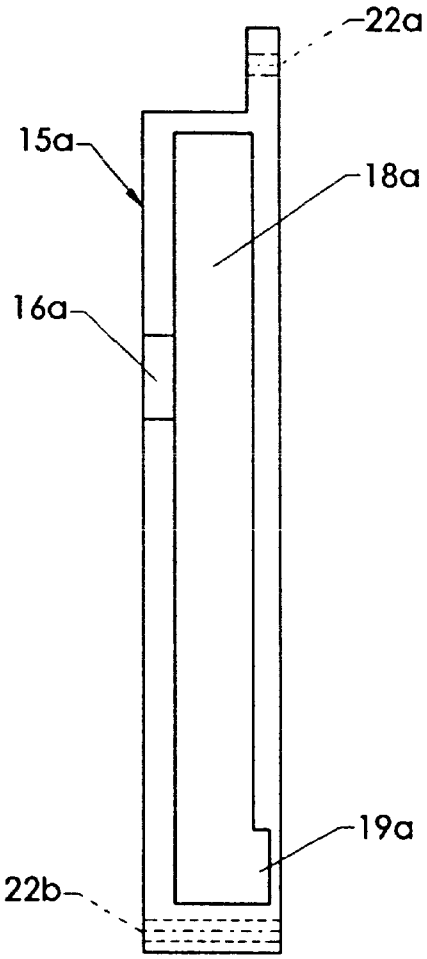
FIG. 4B is a right side elevation view of the slide block of FIG. 4A.
Figure 4A:
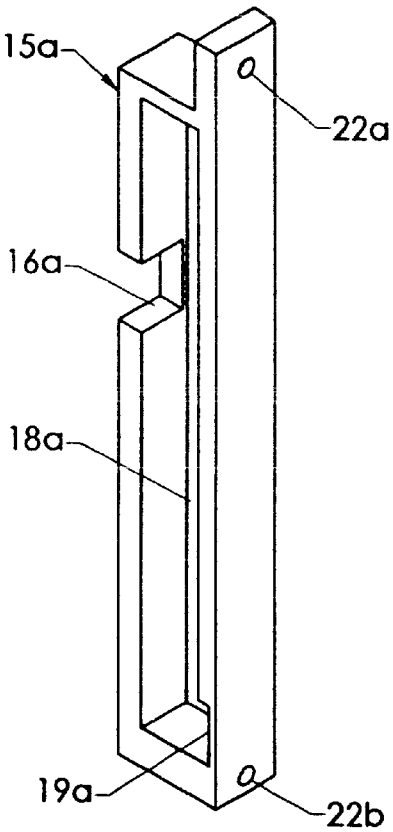
FIG. 4A is an enlarged perspective view of one of a pair of slide blocks employed in the preset invention.

Referring to the drawings in detail, wherein like numerals indicate like elements, there is shown in FIGS. 1, 2, 3, 5, 6, and 7, a preferred embodiment of the fold out bench type boat seat assembly 10 of the present invention and in FIGS. 4A, 4B, and 4C various component details.

Figure 5:
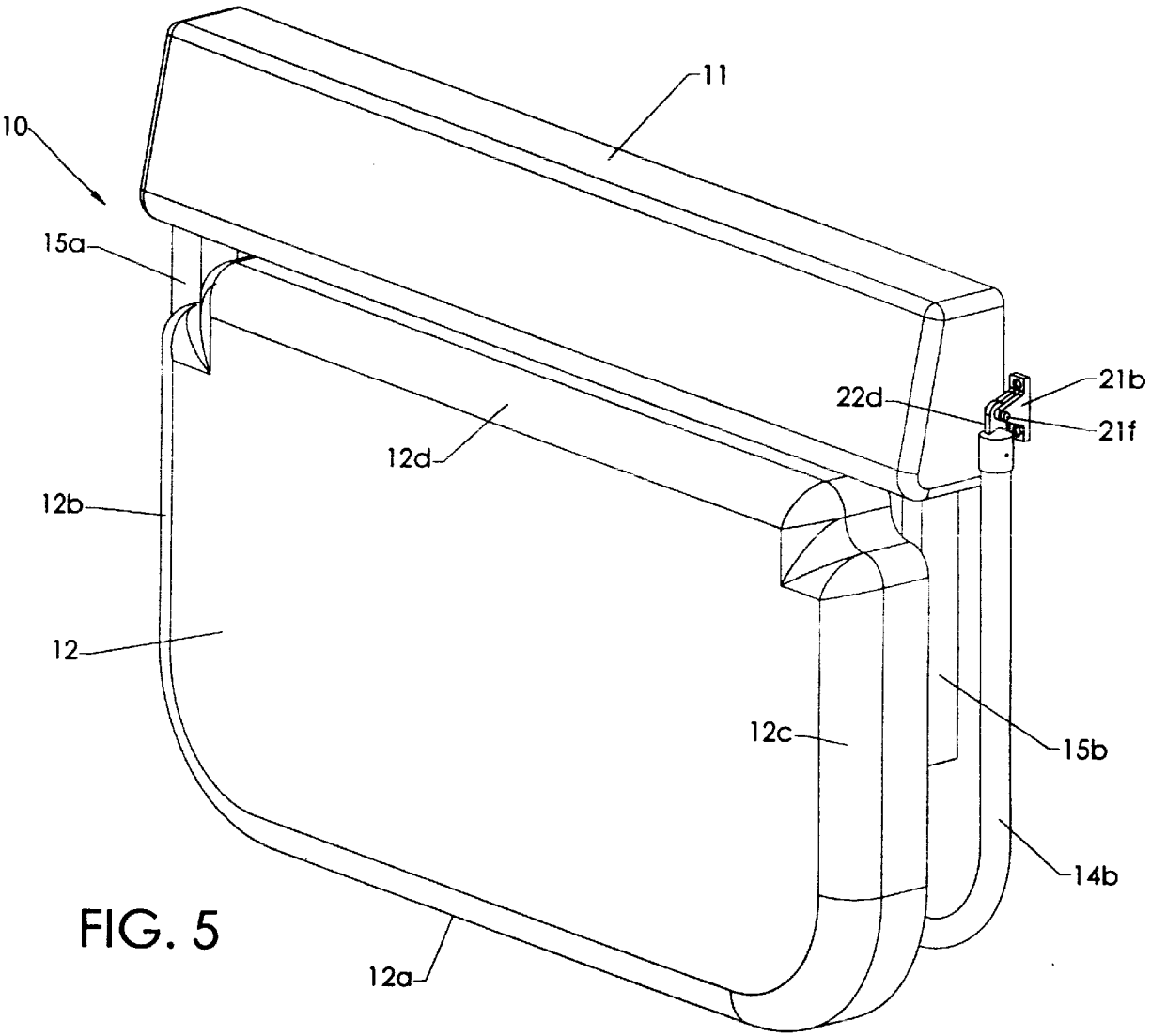
FIG. 5 is a perspective view of the fold out bench type seat assembly of FIG. 1 but with the seat unit in a vertical stowed position.
Figure 6:
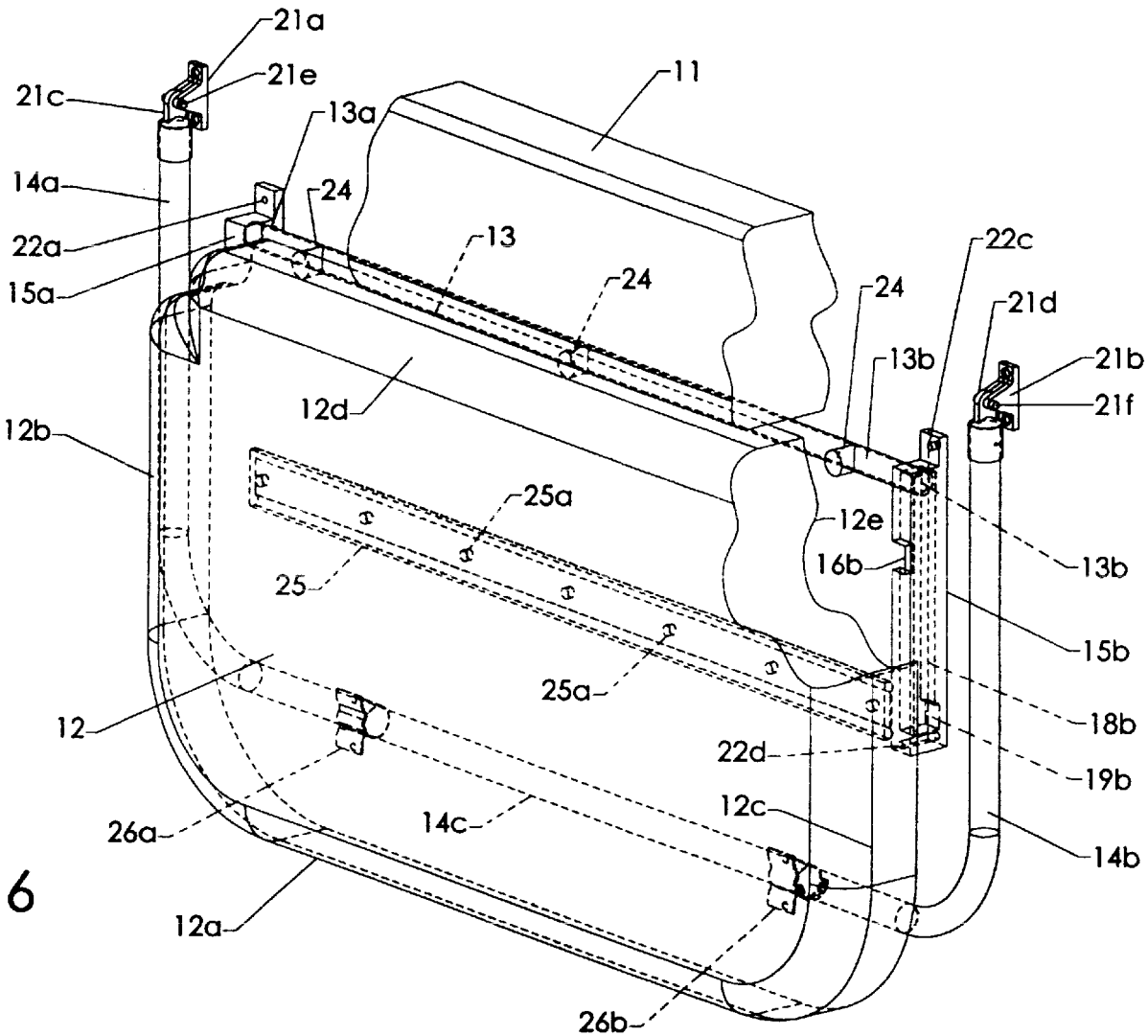
FIG. 6 is a a perspective view similar to that of FIG. 5 but with portions thereof broken away for illustrative purposes and with various hidden parts shown in dashed lines.

Fold out bench type boat seat assembly 10 comprises: a back support 11 that is typically fixedly attached to the bulkhead of a boat by suitable conventional means, e.g. bolts and screws (not shown) or by being formed integral with the boat bulkhead, and a seat 12 that works in conjunction with back support 11 but that is movable from a horizontal seating position (as in FIG. 1) to a vertical stowed position (as in FIG. 5).

The novelty of the present invention resides primarily in the seat unit and its associated mounting and folding mechanisms. In this regard, a pair of vertically mounted, laterally spaced slide blocks 15*a*, 15*b* (see FIGS. 4A, 4B, 4C for details of representative block 15*a*) are fixedly secured to the boat bulkhead by suitable bolts and screws (not shown) passing through holes 22*a*, 22*b* of left block 15*a* and holes 22*c*, 22*d* passing through right block 15*b*. Blocks 15*a*, 15*b* are adapted to receive, by way of a pair of insertion ports 16*a*, 16*b* (FIG. 2) respectively the opposed ends 13*a*, 13*b* of a slide rod 13.

Slide rod 13 is integrally and rigidly secured to the bottom portion 12*a* of seat 12 adjacent the rear thereof by studs 24 which are integrally secured in bottom 12*a* of seat 12. Once ends 13*a*, 13*b* of rod 13 are passed through insertion ports 16*a*, 16*b* respectively, opposed rod ends 13*a*, 13*b* (FIG. 7) ride up or down within slide grooves 18*a*, (FIG. 4A), 18*b* (not shown) of slide blocks 15*a*, 15*b*. Thus, seat 12 can be moved up or down as opposed rod ends 13*a*, 13*b* move up or down in slide grooves 18*a*, 18*b* respectively. When in a down position so that fold out bench type boat assembly 10 is useful as a seat, rod ends 13*a*, 13*b* respectively rest in stop blocks 19*a* (FIG. 4A), 19*b* (FIG. 6) of slide blocks 15*a*, 15*b*. Hence, seat 12 is effectively locked when in a down position.

Reference is next made to FIGS. 1, 5, 6, and 7 and the fold out bench type boat seat assembly 10 illustrated therein. Seat 12 comprises a front portion 12*a*, two opposed side portions 12*b*, 12*c*, a rear portion 12*d*, and a bottom portion 12*e*. Seat 12 is supported under its front portion by a U-shaped frame or support 14. U-shaped frame or support 14 comprises a pair of side arms 14*a*, 14*b* (FIG. 2) and an intermediate front cross bar 14*c*. Arms 14*a*, 14*b* and cross bar 14*c* are interconnected and designed in such a way as to eliminate a "pinch point" between the support 14 and seat bottom position portion 12*e* during raising and lowering of seat assembly 10. Side arms 14*a*, 14*b* are attached at their respective inner ends to the boat bulkhead by a pair of pivoting connecters 21*a*, 21*b* which are integrally secured to the boat bulkhead by bolts and screws (not shown). Side arms 14*a*, 14*b* have integral with their respective inner ends a pair of hinge connectors 21*c*, 21*d* (FIGS. 2 and 6) which are pivotally attached to pivoting connectors 21*a*, 21*b* (FIG. 2) by a pair of respective hinge pins 21*e*, 21*f*.

Figure 1:
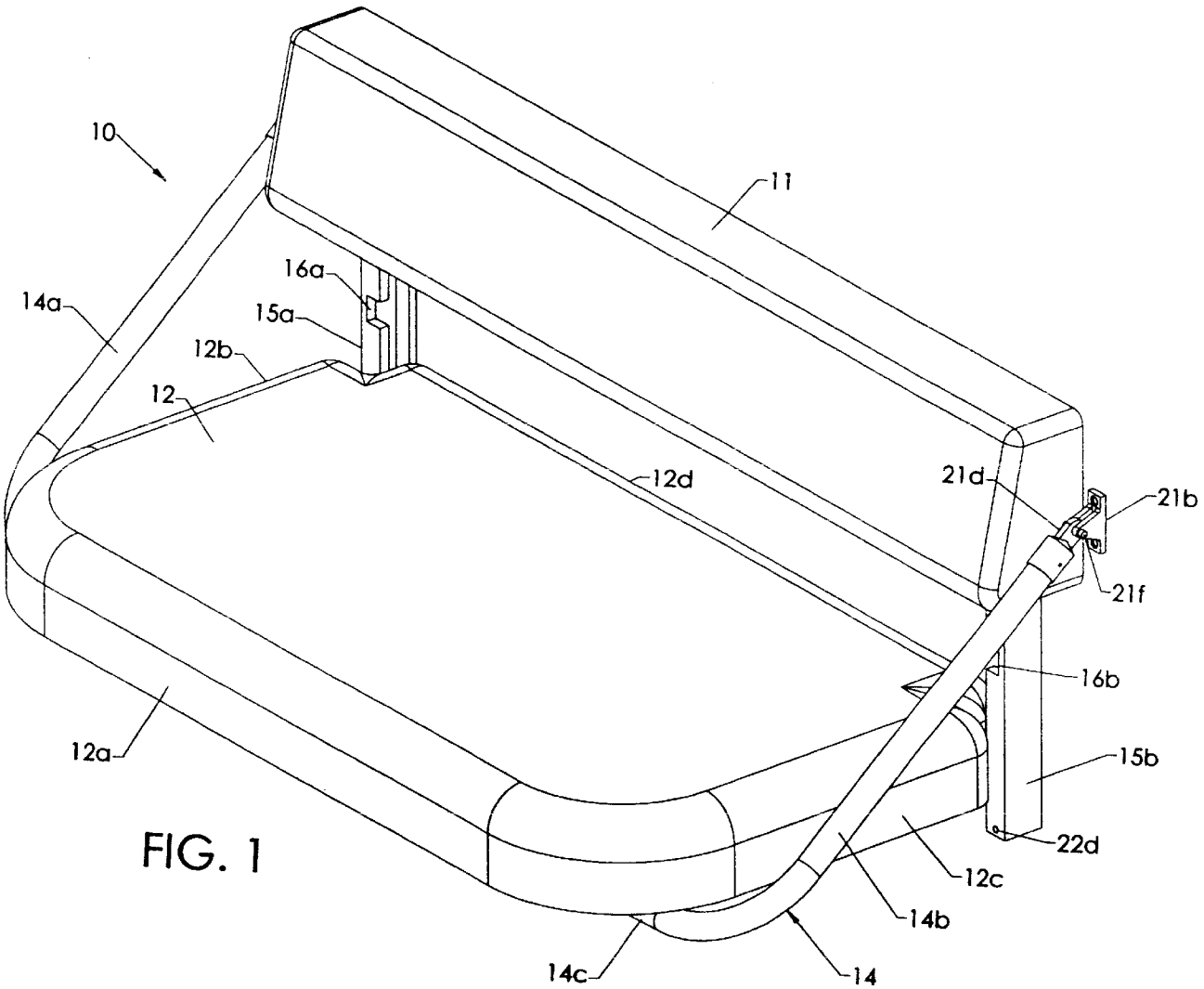
FIG. 1 is a perspective view of a fold out bench type boat seat assembly according to the preferred embodiment of the present invention with the seat unit in a folded out seating position.
Figure 2:
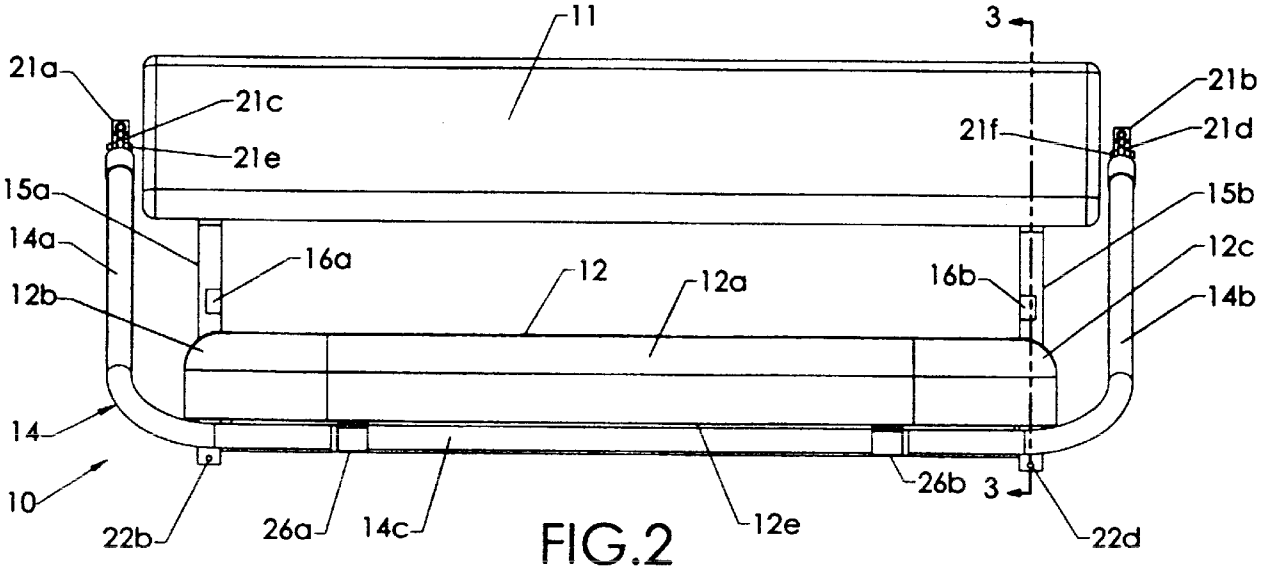
FIG. 2 is a front elevation view of the fold out bench type boat seat assembly of FIG. 1 with seat in a folded out seating position.
Figure 3:
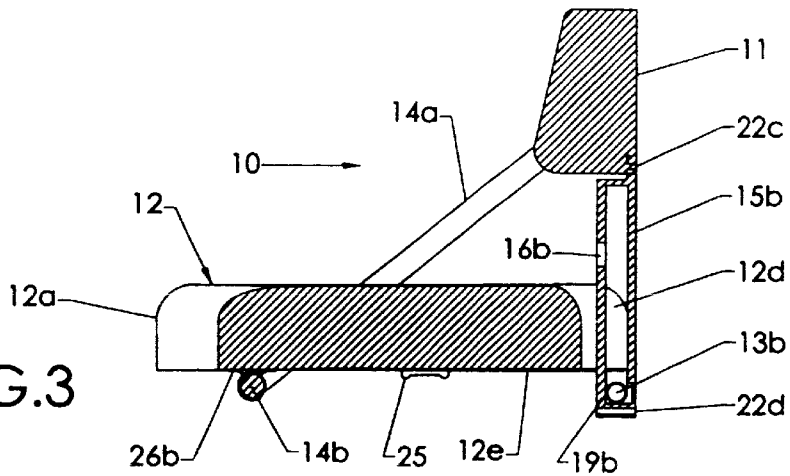
FIG. 3 is a section view taken substantially along line 3—3 of FIG. 2.
Figure 7:
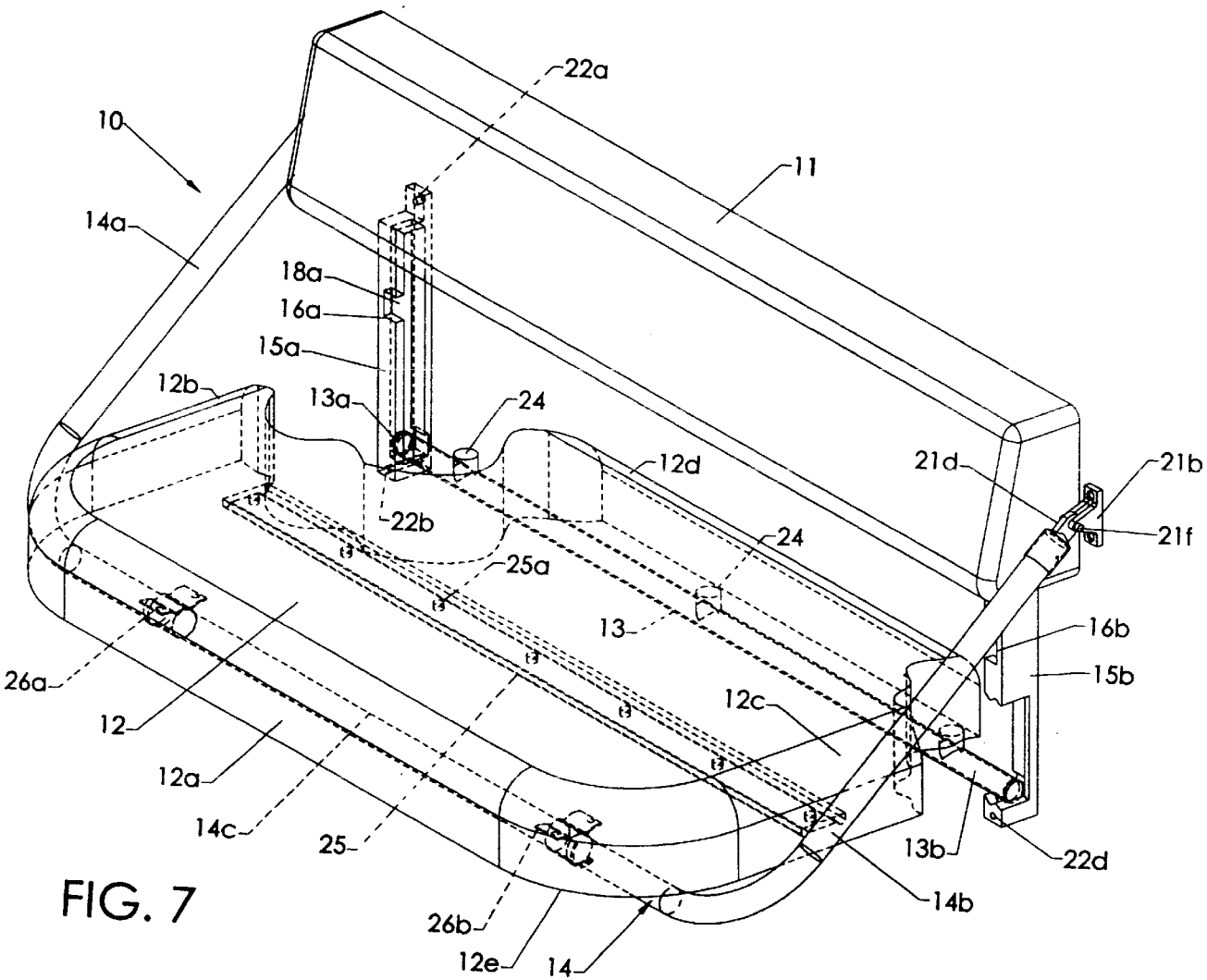
FIG. 7 is a perspective view similar to that of FIG. 1 but with portions thereof broken away for illustrative purposes and with various hidden parts shown in dashed lines, the seat unit being in a folded out seating position.

As previously described, seat 12 is detachably mounted to the boat bulkhead on each side by slide rod ends 13*a*, 13*b* (see FIG. 7) that sit inside slide blocks 15*a*, 15*b* respectively, one on each side of seat 12 and which are fixedly attached to the bulkhead. Seat 12 is adapted to be folded up and against the boat bulkhead when not in use (see FIG. 5) and being retained there. The intermediate front crossbar 14*c* of U-shaped frame 14 which supports the outermost portion of seat 12 is loosely received by a pair of front crossbar brackets 26*a*, 26*b* secured to the bottom portion. 12*e* of seat 12 (FIGS. 2 and 7). When it is desired to fold up seat 12 into the FIG. 5 position, the rear 12*d* of seat 12 is lifted and pivoted upward by the boat user as it is being guided by slidable rod ends 13*a*, 13*b* inside their respective slide blocks 15*a*, 15*b*. The front 12*a* of seat 12 and U-shaped frame 14 pivot downwardly until seat 12 is essentially flat against the bulkhead directly beneath back support 11. Front crossbar brackets 26*a*, 26*b* allow front cross bar 14*c* to be snap fitted therein which allows seat 12, when not in use, to rest in place against the front surfaces of slide blocks 15*a*, 15*b* mounted on the boat bulkhead. This arrangement permits more space in the boat when seat 12 is not in use and still allows access to and use of the boat bulkhead area behind the seat. As previously mentioned, the design and arrangement of frame 14 avoids establishing a "pinch point" between frame 14 and seat bottom portion 12 during raising and lowering of the seat assembly 10.

Seat 12 has a rigid, stiffener 25 (FIG. 6) integrally secured by screws 25*a* to bottom portion 12*e* thereof. Stiffener 25 adds rigidity to seat 12. Seat stiffener 25 is of sufficient length such that when seat 12 is moved into its raised stowed position, stiffener 25 resides between slide blocks 15*a*, 15*b* with seat bottom portion 12*e* resting against the front surfaces of slide blocks 15*a*, 15*b*.

Seat assembly 10 permits more space in the boat when the seat is not in use and still allows access to and use of the area behind the seat, inside the bulkhead, for storage of items, e.g. clothing, fishing gear, etc., if desired. It also solves the need to preserve boat floor area for movement of the fisherman. This type of bench seats arrangement may be useful in other settings where a foldable seat is needed to preserve other storage areas. Further, seat 12 can be removed and stored when it is not needed for use as a seat. For removal of seat 12, the boat user need only snap front crossbar 14*c* of U-shaped frame 14 from front crossbar brackets 26*a*, 26*b*. Then, rear seat portion 12*d* of seat 12 is raised at the rear thereof thus allowing slide rod ends 13*a*, 13*b* of rod 13 to be moved upwards in their respective slide blocks 15*a*, 15*b* until they are aligned with their respective insertion ports 16*a*, 16*b*. At this point, slide rod ends 13*a*, 13*b* are moved outward from their respective slide blocks 15*a*, 15*b*. Thus, seat 12 is free to be removed and stored in a suitable place. Only back support 11, U-shaped frame 14, associated bulkhead pivoting connectors 21*a*, 21*b*, and slide blocks 15*a*, 15*b* are left remaining substantially flush against the boat bulkhead out of way of the fisherman. Frame 14 may also be removed simply by removing the pins 21*e*, 21*f*.

In summary, when compared to boat seat and seat assemblies of the prior art, the fold out boat seat assembly of the invention offers the following advantages, among others:

(a) When in a stored position, the assembly takes up virtually no space inside the boat.

(b) The assembly can be mounted on any flat or substantially flat, vertical or substantially vertical bulkhead or other surface.

(c) The assembly can be mounted below an existing bolster of normal size and fit within the confines of the bolster.

(d) The assembly requires no new boat tooling in order to integrate the assembly into virtually any of the multitude of boat designs found in the industry.

(e) The assembly can be mounted on the bulkhead or other appropriate surface in a position such that it does not extend to the floor of the boat and thus provides access to the space below the assembly in either its stored or open position.

(f) When the assembly is in its stored position, there is virtually no reduction in either cockpit space or fishing room.

(g) Access to any storage area or stored items such as a fishbox or cooler located behind the bulkhead surface on which the assembly is mounted are still accessible.

(h) By reason of the major parts of the assembly being removable without the use of tools, access to pumps, fuel fittings, batteries and other items located near where the assembly is mounted remain accessible.

(i) Since the vertical slide rails of the assembly can be installed on any flat surface, the assembly, when used on a molded boat, does not require mold modification.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A fold out seat assembly for a boat having a bulkhead, comprising:

(a) a seat, comprising a front surface, two opposed sides, a back surface, a top surface, and a bottom surface, each said side having a slide rod end extending perpendicularly from the respective said seat side adjacent said back surface of said seat;

(b) a U-shaped frame comprising two sides and a connecting crossbar, each said frame side having an inner end pivotally supported by said boat bulkhead above said seat, and said crossbar being pivotally mounted on and operative to support said bottom surface below and proximate the front surface of said seat during use thereof;

(c) a pair of substantially vertical, laterally spaced, parallel slide blocks integrally secured to an inner surface of said boat bulkhead, each slide block comprising an insertion port at an upper end of said slide block positioned opposite an insertion port of similar construction on the other slide block and adapted to permit a respective said slide rod end on the side of said seat to be inserted in or removed from the said slide block, a slide groove in which said slide rod end slides up and down, and a stop section at a bottom end of said slide block adapted to maintain said slide rod end in a locked position at the bottom end of said slide block when said seat is in a perpendicular position relative to the plane of said boat bulkhead; and (d) said seat, frame, and slide blocks forming said assembly being configured to mount on said bulkhead so as to permit said seat and frame to be removed from said slide blocks and bulkhead when desired and said seat and frame to be used or stored on said slide blocks without support other than as provided by said, frame, slide blocks, and bulkhead.

2. A fold out seat assembly as claimed in claim 1 including a back support attached to the bulkhead of the boat above the seat assembly said slide blocks extending below opposite ends of said back support.

3. A fold-out seat assembly as claimed in claim 1, wherein said seat frame and slide blocks forming said assembly are also configured so as to enable said frame and seat to be positioned either for use or to be stored on the bulkhead by a single motion.

4. A fold-out seat assembly as claimed in claim 1, wherein said frame inner ends pivotally attached to said bulkhead and said crossbar pivotally mounted to said bottom surface comprise forms of attachment and mounting which enable both said inner ends and said crossbar to be readily detached and said fold-out seat assembly to be removed as a unitary assembly from said bulkhead.

5. A fold out seat assembly as claimed in claim 1, wherein said bulkhead comprises a flat interior vertical surface of said boat.

6. A fold out seat assembly for a boat having a bulkhead, comprising:

(a) a back support;

(b) a seat, comprising a front portion, two opposed sides, a back portion, and a bottom surface;

(c) a slide rod fixed to said bottom surface of said seat near said back portion, said slide rod having a length greater than the width of said back portion and forming a pair of slide rod ends, each of which extends perpendicularly from a said side at said back portion of said seat;

(d) a U-shaped frame comprising two sides and a crossbar, each frame side having an inner end pivotally supported by said boat bulkhead, and said crossbar bar being mounted to support said bottom surface of said seat proximate its said front portion during use of said seat;

(e) a pair of vertical, laterally spaced, ,parallel slide blocks fixedly attached to said boat bulkhead, each said slide block comprising:

(i) a slide groove in which a respective said slide rod end slides up and down;

(ii) an insertion port at an upper end of each said slide block through which a respective slide rod end is inserted into or removed from said slide groove; and (iii) a stop section formed at the bottom end of each said slide block to maintain said slide rod end in a locked position at said bottom end of said slide block when said seat is in a seating position; and (f) said seat, frame, and slide blocks forming said assembly being configured to mount on said bulkhead so as to permit said seat and frame to be removed from said slide blocks and bulkhead when desired, and said seat and frame to be used or stored on said slide blocks without support other than as provided by said frame, slide blocks, and bulkhead.

7. A fold-out seat assembly for a boat having a substantially flat vertical wall capable of supporting the normally loaded weight of said assembly, comprising:

(a) a seat, comprising a front surface, two opposed sides, a back surface, a top surface, and a bottom surface, each said side having a slide rod end extending perpendicularly from the respective said seat side adjacent said back surface of said seat;

(b) a U-shaped frame comprising two sides and a crossbar, each said frame side having an inner end pivotally attached to an inner surface of said boat wall above said seat, and said crossbar being pivotally mounted on said seat below said front surface; and (c) a pair of substantially vertical, laterally spaced, parallel slide blocks integrally secured to said inner surface of said boat wall, each slide block comprising an insertion port at an upper end of said slide block adapted to receive a respective said slide rod end on the side of said seat and a slide groove in which said slide rod end slides up and down; and (d) wherein said frame inner ends pivotally attached to the said inner surface of said boat wall and the said crossbar pivotally mounted on said seat below said front surface comprise forms of attachment and mounting which enable both said inner ends and crossbar to be readily detached and said fold-out seat assembly to be removed as a unitary assembly from said wall.

8. A fold-out seat assembly for a boat having an interior vertical wall with a surface and construction suited for use as a support, comprising:

(a) a seat having top, bottom, two opposed side, rear and front surfaces;

(b) a rod structure secured to said seat proximate said rear surface and having a pair of axially aligned rod ends, each of which said rod ends projects perpendicularly outward from a respective one of said side surfaces;

(c) a pair of vertical, laterally spaced, parallel slide blocks secured to said interior wall, each slide block having a slide groove in which a rod end can slide up and down, an insertion port at an upper end of said groove adapted to permit a rod end to be inserted in said block for vertical sliding in said groove or to be removed from said block and a stop section at a bottom end of each said slide block adapted to maintain a slide rod end in a locked position at the bottom of the respective said slide block when said seat during use is in a perpendicular position relative to the plane of said interior wall;

(d) a support frame having an upper portion detachably secured to said interior wall and a lower portion adapted to support an outer portion of said seat without interference with the space below said seat; and (e) said seat, rod structure, slide blocks, and frame being configured to permit a rear portion of said seat while in use to be supported by means of said rod ends between and on said slide blocks, a front portion of said seat to be supported by the lower portion of said frame, and when said seat is not in use permits said seat and frame to be stored vertically adjacent said slide blocks or said seat to be removed from said slide blocks and said frame to be detached from said interior wall.

* * * * *